US005992912A

United States Patent [19]

Zimm

[11] Patent Number: 5,992,912

[45] Date of Patent: Nov. 30, 1999

[54] PORTABLE TRAY AND STAND

[76] Inventor: George E. Zimm, 371 Kings Hwy., Mickleton, N.J. 08056

[21] Appl. No.: 09/050,345

[22] Filed: Mar. 30, 1998

[51] Int. Cl.[6] ..... A45F 5/10

[52] U.S. Cl. ..... 294/143; 294/146; 294/172; 206/1.7; 220/770; 220/756; 248/126; 211/74; 211/85.18

[58] Field of Search ..... 294/143, 144, 294/146, 159, 161, 172; 206/1.7–1.9, 575; 220/770, 771, 756, 763; 248/126, 351, 441.1; 211/74, 71.01, 85.18

[56] References Cited

U.S. PATENT DOCUMENTS

| | | | |
|---|---|---|---|
| 2,525,633 | 3/1950 | Arnett | 294/143 |
| 2,568,405 | 10/1951 | O'Malley | 211/130.1 |
| 2,663,391 | 5/1953 | Kuhns | 220/771 |
| 2,738,606 | 4/1956 | Klein | 206/1.7 |
| 3,151,791 | 10/1964 | Pietsch | 294/142 |
| 3,300,055 | 1/1967 | Rohr | 211/74 |
| 3,878,964 | 4/1975 | Fogle | 294/142 |
| 4,218,008 | 8/1980 | Veilleux | 229/15 |
| 4,901,846 | 2/1990 | Lehman | 206/1.8 |
| 4,972,943 | 11/1990 | Fludd | 206/1.7 |
| 5,147,038 | 9/1992 | Pergeau | 211/85.18 |
| 5,615,782 | 4/1997 | Choe | 211/70.6 |
| 5,632,388 | 5/1997 | Morrison et al. | 211/74 |
| 5,660,284 | 8/1997 | Vaughn | 211/41.1 |

FOREIGN PATENT DOCUMENTS

| | | | |
|---|---|---|---|
| 819392 | 9/1959 | United Kingdom | 52/3 |

*Primary Examiner*—Dean J. Kramer
*Assistant Examiner*—Paul Chin
*Attorney, Agent, or Firm*—Volpe and Koenig, P.C.

[57] ABSTRACT

A tray for storing, transporting and presenting various articles. The tray includes a storage platform and a handle member extending therethrough. The storage platform includes an array of variously shaped receptacles. The handle is movable between a first position wherein the platform is maintained in a first orientation and a second position wherein the platform is maintained in a second orientation.

17 Claims, 7 Drawing Sheets

PORTABLE TRAY AND STAND

BACKGROUND OF THE INVENTION

1. Field of the Invention

The present invention generally relates to a tray for storage and transportation of various items. More particularly, the present invention relates to a storage and transportation tray which can also be used as a stand for presenting the items in an organized manner.

2. Description of the Prior Art

Many art and craft supplies are provided in various bottles, tubes, and jars. These various items are often scattered about an artist's or craft person's work area in an unorganized fashion. Furthermore, when it is necessary to transport the various items, for example when attending a class, the person often piles the items in a box, cookie tin or some other container and carries the container to the class. Once at the class, all of the items must be removed and set out in the new work space, or a hunting game must take place to find a particular color or item that is buried in the container. Once the class is over, all of the items are thrown back into the container and the process starts again.

This problem is not unique to artists and craft persons, but is experienced by many other people as well. For example, manicurists often have their nail polish bottles scattered about in no particular arrangement. This makes it difficult for a client to see the various colors available and also for the manicurist to locate a desired color. The problem is further enhanced when the manicurist makes house calls because there is also a need to transport various items.

Accordingly, there is a need for a tray which can store and transport various small items in an organized manner. It is also desirable for the tray to allow the items to be presented for use in an organized manner.

SUMMARY OF THE INVENTION

The present invention relates to a tray for storing, transporting and presenting various articles. The tray includes a storage platform and a handle member extending therethrough. The storage platform includes an array of variously shaped receptacles. The handle member is movable between a position wherein the platform is maintained in a transportation orientation and a position wherein the platform is in a raised, stand orientation.

DESCRIPTION OF THE PREFERRED EMBODIMENTS

Figure 1:
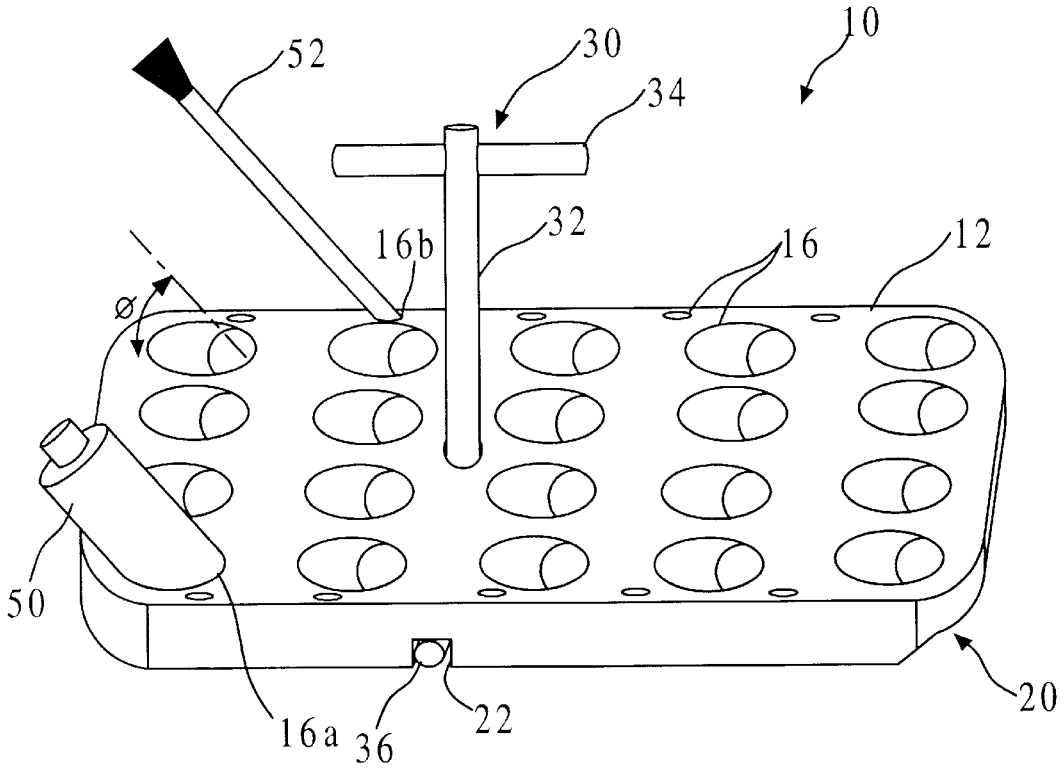
FIG. 1 is a perspective view of the tray in accordance with the present invention in the transport position.

The preferred embodiments will be described with reference to the drawing figures wherein like numerals represent like elements throughout.

The preferred tray 10 is shown in FIG. 1 and generally comprises a storage platform 12 and a handle member 30. The platform 12 has an aperture 14 through which the stem 32 of the handle 30 passes. The aperture 14 is preferably positioned along the center line extending along the length of platform 12 and slightly forward of the center line extending across the width of platform 12.

The handle member 30 generally comprises the main stem 32, an upper cross member 34 adjacent to, and extending perpendicular to, one end of the main stem 32 and a lower cross member 36 adjacent to, and extending perpendicular to, the opposite end of the stem 32. The main stem 32 preferably has a diameter which is slightly smaller than that of the aperture 14. This allows the stem 32 to move through the aperture 14 while still providing a sufficient friction force to maintain the tray 10 in the stand position. The upper cross member 34 provides a means to grip and carry the tray 10. The lower cross member 36 provides the tray 10 with stability in the stand position, as will be described in more detail hereinafter. The platform 12 is preferably provided with a slot 22 where the lower handle cross member 36 is positioned in the transport and storage position so the tray 10 can sit flat on a surface. The slot 22 may be provided with securing means, such as a snap clasp (not shown), to maintain the lower handle cross member 36 in position.

Figure 3:
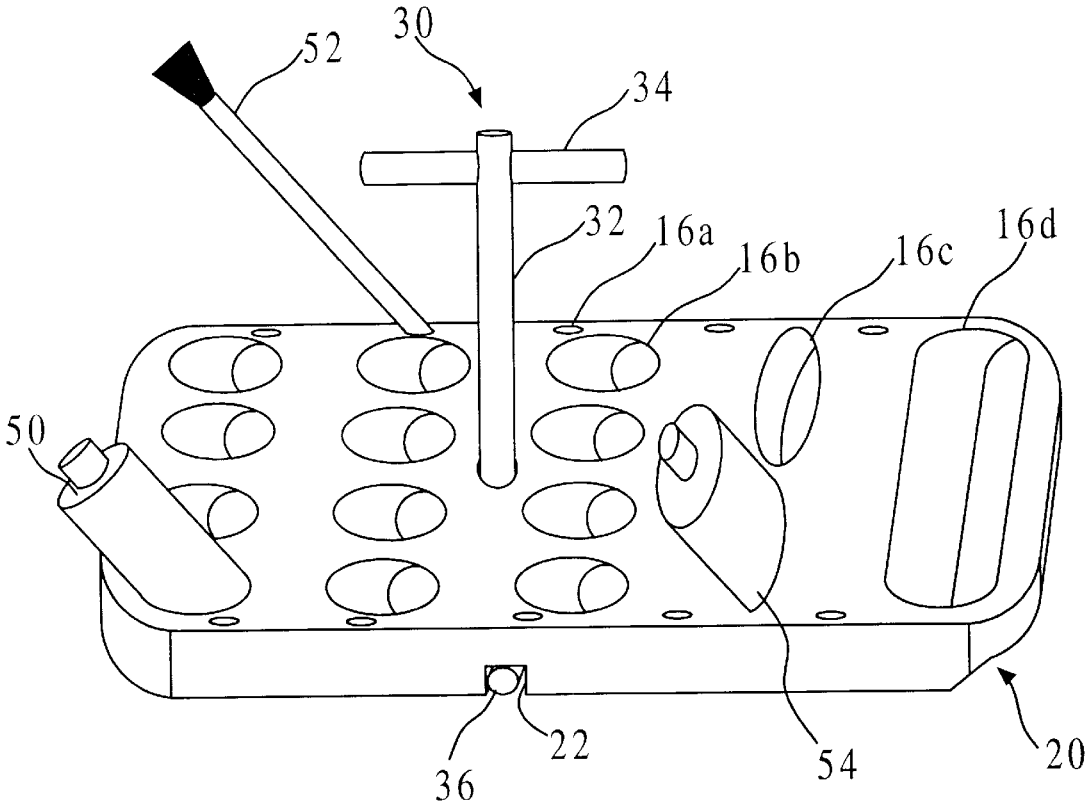
FIG. 3 is a perspective view of a an alternate embodiment of the present invention.

The platform 12 includes a number of receptacles 16 for receiving various items. In the embodiment shown in FIG. 1, a first set of receptacles 16*a* are sized to accommodate two (2) ounce paint bottles 50, and a second set of receptacles 16*b* are sized to receive paint brushes 52 or the like. As shown in FIG. 3, the receptacles 16 can have any number of various shapes and sizes. For example, receptacles 16*c* are elliptical to receive tubes of paint 54 and receptacle 16*d* is in an elongate trough for receiving various items such as erasers, sponges, knives, etc.

Figure 4:
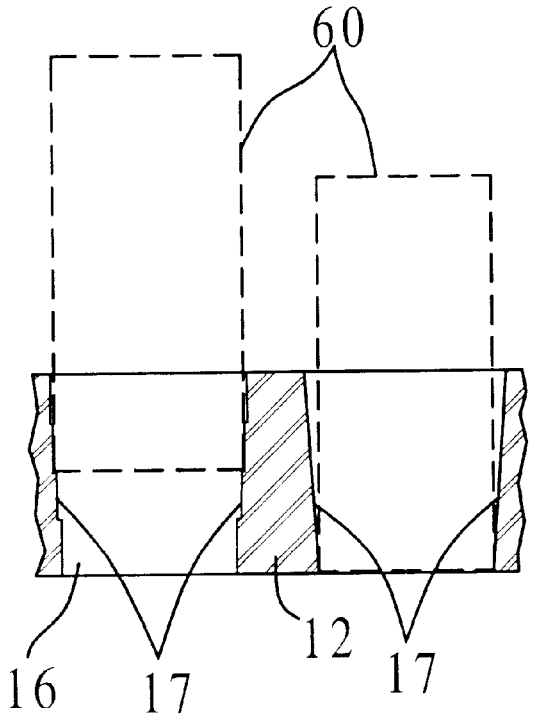
FIG. 4 is a cut-away view of a portion of a second alternate embodiment of the present invention.
Figure 5:
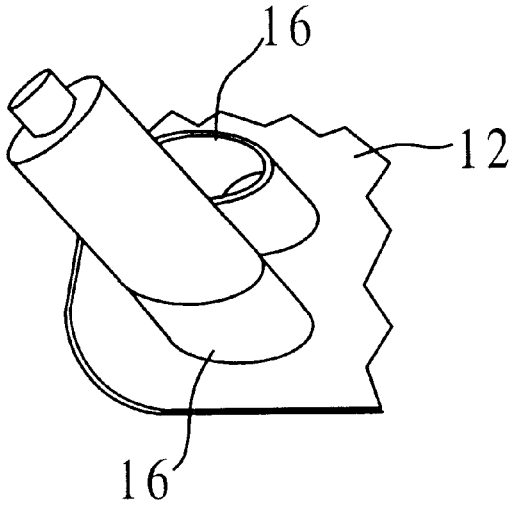
FIG. 5 is a partial perspective view of a third alternate embodiment of the present invention.

As shown in FIG. 4, the receptacles 16 can be provided with tapered or stepped walls 17 to allow them to accommodate items 60 of different sizes. Additionally, as illustrated in FIG. 5, the receptacles 16 can extend from or below the platform 12.

Figure 2:
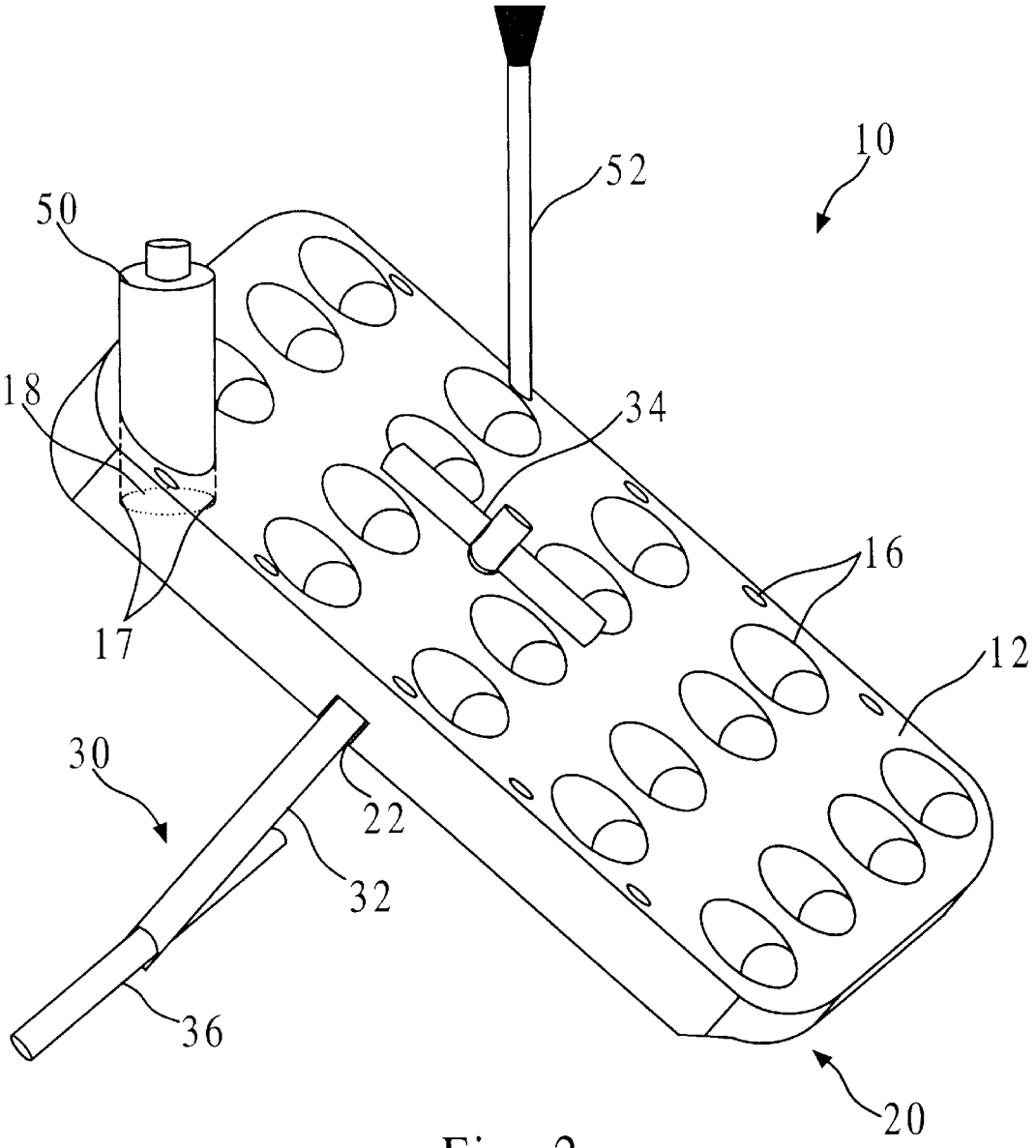
FIG. 2 is a perspective view of the tray in accordance with the present invention in the stand position.

Referring again to FIG. 1, the center line CL of each receptacle 16 is preferably at an angle ø relative to the plane of platform 12. The angle ø is preferably equal to 90° minus the angle of the platform 12 relative to a horizontal plane when it is in the stand position. As shown in FIG. 2, this angle positions the base 18 of each receptacle 16 in a generally horizontal orientation and the various items 50,52 stored therein in generally upright positions when the tray 10 is in the stand position.

Positioning of the tray 10 in the stand position will be described with the reference to FIG. 2. The handle stem 32 is moved through the aperture 14 until the upper cross member 34 is adjacent to the platform 12. Preferably, the upper cross member 34 is in contact with the platform 12 to provide greater stability, however, it is not required since the friction between the aperture 14 and the handle stem 32 will generally maintain the tray 10 in the stand position. With the handle 30 moved, the stem 32 and lower cross member 36 define a leg which allows the tray 10 to be placed in the raised stand position. The lower handle cross member 36 and the front edge 20 of the tray 10 provide the platform 12 stability in the raised position. As shown in FIGS. 1 and 2, the front edge 20 of the platform 12 is preferably tapered to provide the tray 10 with greater stability in the stand position.

With the tray 10 in the stand position, the items 50–54 are presented in an organized, useable manner. For example, the different color paints are more identifiable to allow a desired paint to be quickly located and removed from the tray 10, or if desired, the paint cap can be removed and the paint used directly from the tray 10.

Figure 6:
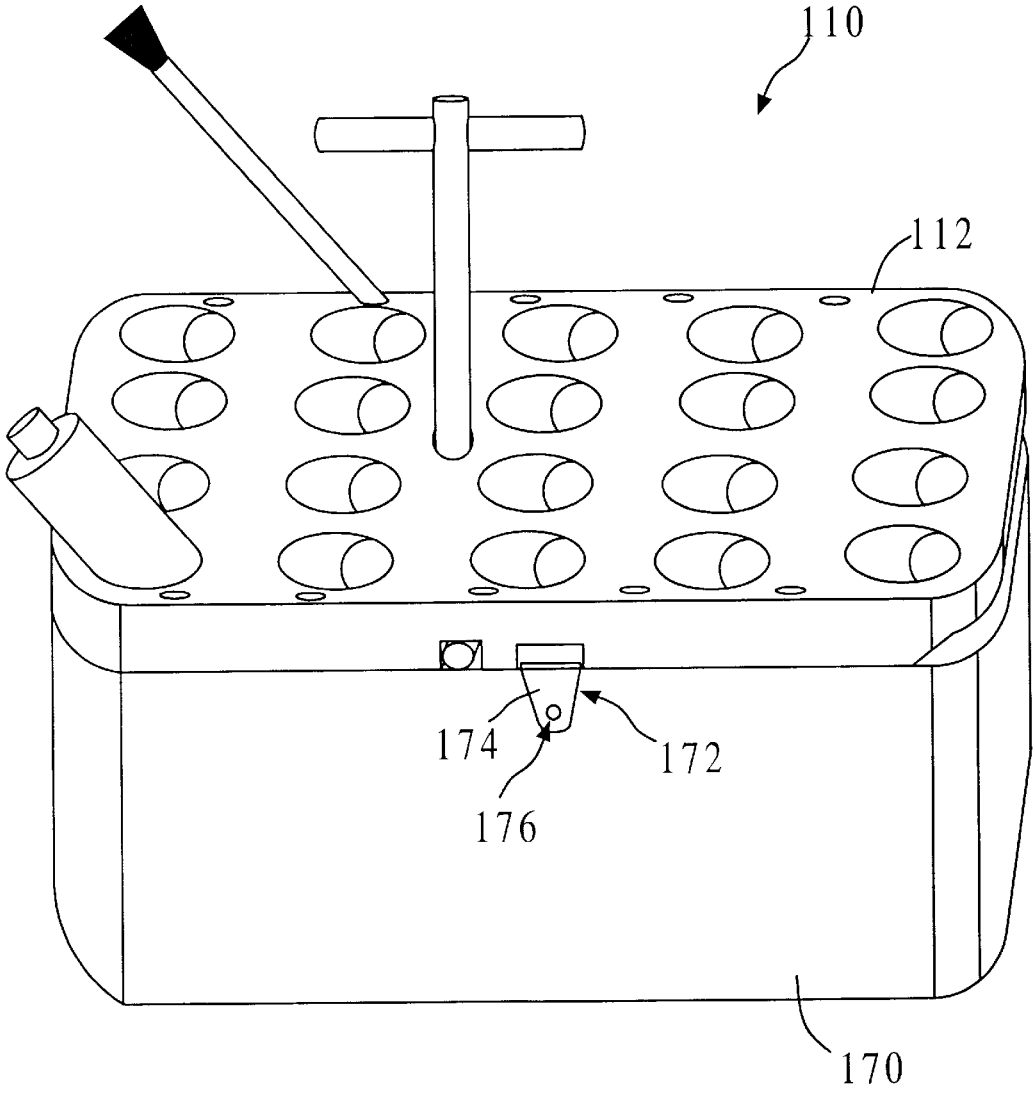
FIG. 6 is a perspective view of a fourth embodiment of the present invention in the transport position.
Figure 7:
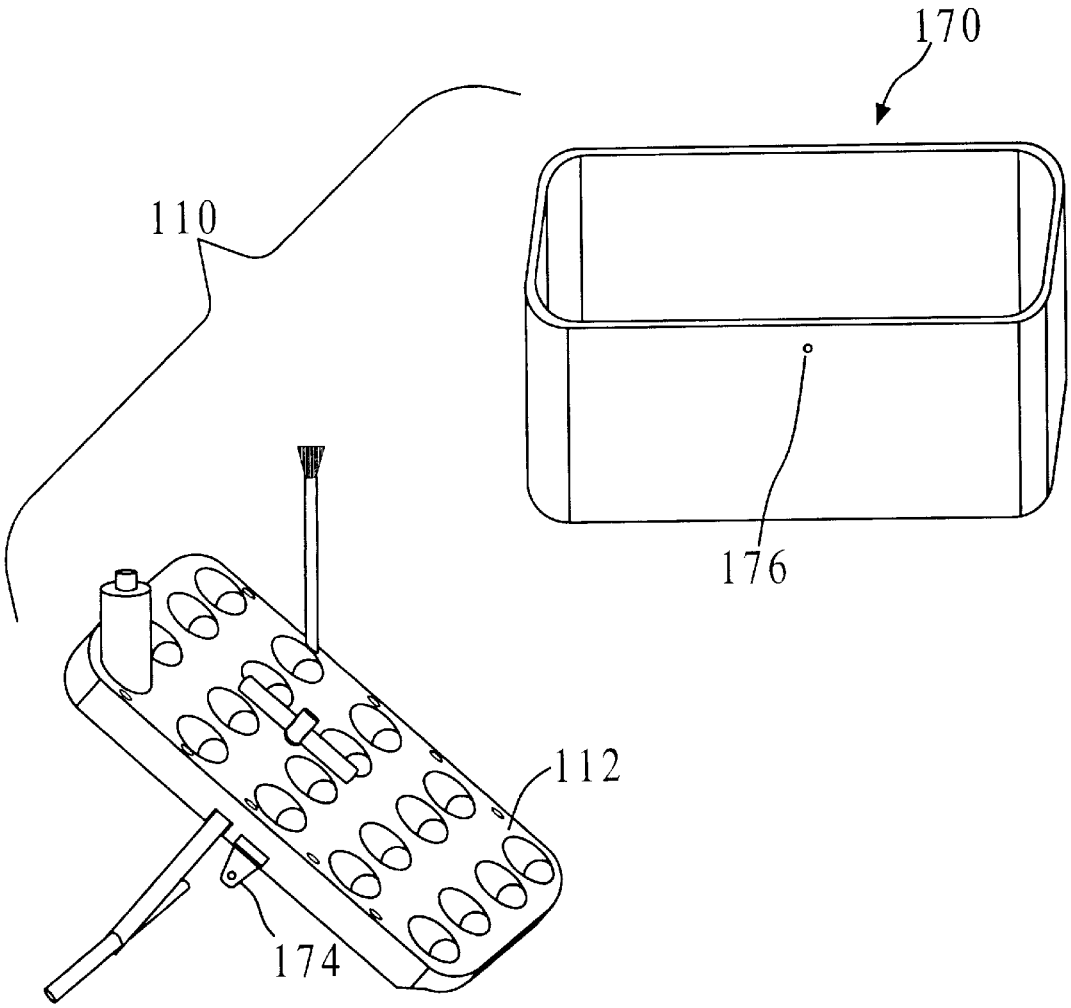
FIG. 7 is a perspective view of the embodiment of FIG. 6 in the stand position.

An alternate embodiment of the tray 110 is shown in FIGS. 6 and 7. In this embodiment, the tray 110 also includes a box 170 to which the platform 112 can be connected in the transport and storage position. The box 170 can be used to store various other items which the user may need, for example, clay, rags, scissors, etc. To interconnect the box 170 with the platform 112, clasp means 172 are provided at various positions around the platform 112 and box 170. Each clasp means 172 preferably comprises a hinged member 174 which mates with a connection member 176. The number, arrangement, and configuration of the clasp means 172 can be varied. To use the platform 112 in the stand position, the clasp means 172 are released and the platform 112 placed in the stand position, as shown in FIG. 7.

Figure 8:
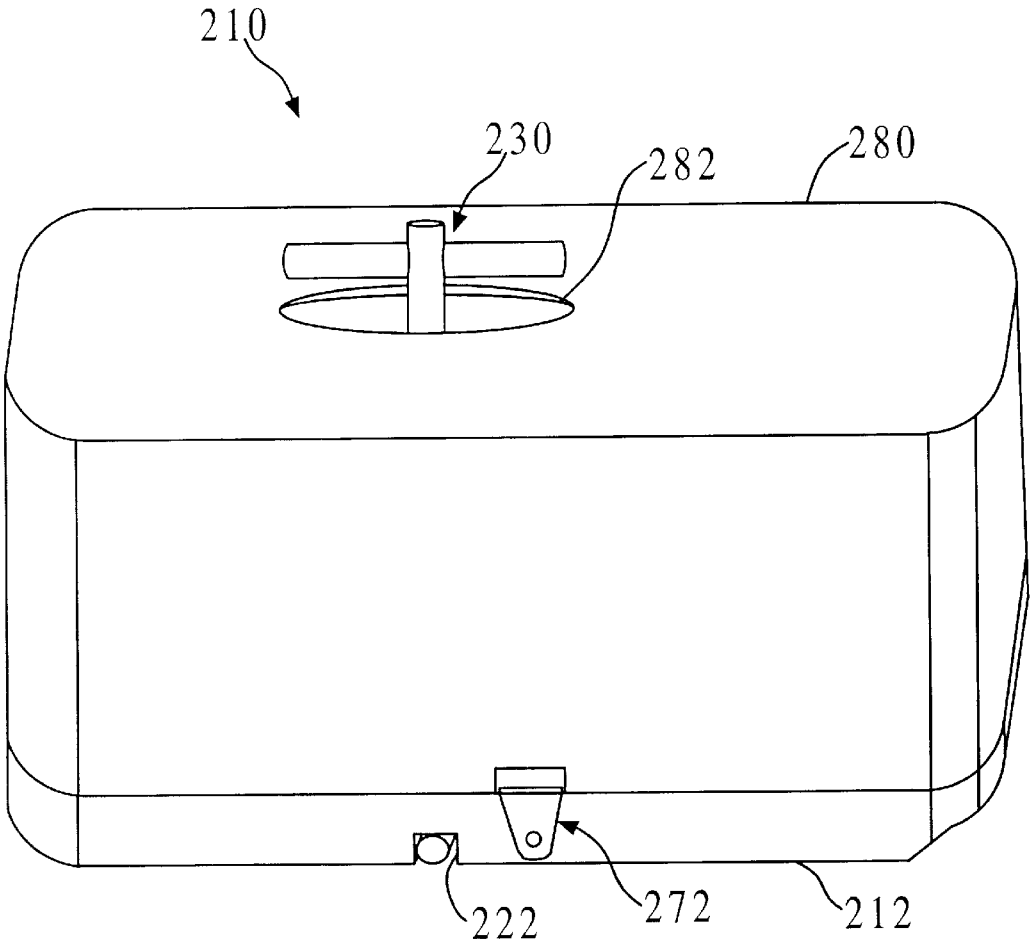
FIG. 8 is a perspective view of a fifth embodiment of the present invention in the transport position.

Another alternate embodiment of the tray 210 is shown in FIG. 8. In this embodiment, the tray 210 includes a cover 280 which is be placed over the platform 212. The cover 280 has an aperture 282 for the handle member 230 to extend through when the tray 210 is in the transport and storage position. It is preferred in this embodiment to include securing means (not shown) in the lower handle member slot 222 to prevent the handle member 230 from falling into the cover 280. The tray 210 can also be provided with with clasp means 272 for connecting the cover 280 to the platform 212.

What is claimed is:

1. A tray for storing and presenting various items comprising:

a storage platform including at least one receptacle and one through passage; and a handle member including an axial portion extending through the passage and movable axially with the passage between a first position wherein the platform is maintained in a storage orientation and a second position wherein the handle member maintains the platform in a presentation orientation.

2. A tray for storing and presenting various items comprising:

storage platform having front and rear surfaces and including at least one receptacle disposed in the front surface; and a handle member extending through the storage platform and movable between a first position wherein a portion of the handle member extends away from the platform front surface to define a handle for transporting the platform and a second position wherein a portion of the handle member extends away from the platform rear surface to define a support leg for supporting an end of the platform in a raised position.

3. The tray of claim 2 wherein the receptacle is selectively configured to support a container in a fixed angular orientation.

4. The tray of claim 3 wherein the fixed angular orientation is substantially horizontal when the platform is in the raised position.

5. The tray of claim 2 wherein the receptacle includes a base which is substantially horizontal when the platform is in the raised position.

6. The tray of claim 2 wherein the receptacle has generally parallel walls which are substantially vertical when the platform is in the raised position.

7. The tray of claim 2 wherein the receptacle has non-parallel walls which are substantially vertical when the platform is in the raised position.

8. The tray of claim 2 wherein the receptacle has stepped walls.

9. The tray of claim 2 further comprising a cover member which covers the platform and includes an aperture aligned with the handle member.

10. The tray of claim 2 further comprising a storage container releasably attached to the storage platform.

11. The tray of claim 2 wherein the platform includes an array of receptacles.

12. The tray of claim 11 wherein all of the receptacles have the same shape.

13. The tray of claim 11 wherein at least two of the receptacles have different shapes.

14. The tray of claim 2 wherein the receptacle is generally cylindrical with a round cross-section.

15. The tray of claim 2 wherein the receptacle is generally cylindrical with an elliptical cross-section.

16. The tray of claim 2 wherein the receptacle is an elongated trough.

17. A tray for storing and presenting various items comprising:

a storage platform including at least one receptacle having a base and one through passage; and a handle member including an axial portion extending through the passage and movable axially with the passage between a first position wherein the base is oriented in a non-horizontal plane and a second position wherein the base is oriented in a generally horizontal plane.

* * * * *